US005478977A

United States Patent [19]

Beasley

[11] Patent Number: 5,478,977

[45] Date of Patent: Dec. 26, 1995

[54] GREASE FLOW SENSOR SWITCH

[76] Inventor: Victor K. Beasley, 1327 Huffman Ave., Dayton, Ohio 45403

[21] Appl. No.: 227,715

[22] Filed: Apr. 14, 1994

[51] Int. Cl.[6] ..... H01H 33/00

[52] U.S. Cl. ..... 200/82 E

[58] Field of Search ..... 200/81 R, 81.9 R, 200/82 R, 82 E, 83 L, 84 C, 61.86; 335/205

[56] References Cited

U.S. PATENT DOCUMENTS

| | | | |
|---|---|---|---|
| 3,632,923 | 1/1972 | Paine et al. | 200/81.9 M |
| 3,738,369 | 6/1973 | Adams et al. | 335/153 X |
| 3,851,127 | 11/1974 | Gardner, Jr. et al. | 200/61.86 |
| 3,896,280 | 7/1975 | Blake | 200/81.9 M |
| 4,166,936 | 9/1979 | Tice | 200/82 E |
| 4,168,413 | 9/1979 | Halpine | 200/82 E |
| 4,181,835 | 1/1980 | Stadler et al. | 200/82 E |
| 4,608,870 | 9/1986 | Huber et al. | 200/82 E X |
| 4,763,114 | 8/1988 | Eidsmore | 200/82 E X |
| 4,962,831 | 10/1990 | Dundas | 200/82 E X |
| 4,996,396 | 2/1991 | Smith | 200/81.9 M |
| 5,070,220 | 12/1991 | Glenn | 200/81.9 M |
| 5,125,280 | 6/1992 | Koscinski et al. | 74/89.15 |

*Primary Examiner*—J. R. Scott
*Attorney, Agent, or Firm*—Joseph P. Burke

[57] ABSTRACT

This disclosure is directed to a grease flow sensor switch assembly device for monitoring and determining movement of grease charges, e.g. a Number One (1) and Number Two (2) type grease. The device involves a dry reed switch, a magnet and a spring the magnet, being moved into position by grease flow, puts out a magnetic field that brings the dry reed switch together, completing an electrical circuit. This circuit is then connected to a fault circuit which shuts off the machine in the event the desired grease charge was not received. An alarm source, viz., a light, sound or light/sound combination alarm indicating that the grease charge (desired amount of grease) was not distributed to that bearing or slide or whatever mechanism is being greased can also be present. The grease volume ban be monitored by adjustments to the dry reed switch.

12 Claims, 3 Drawing Sheets

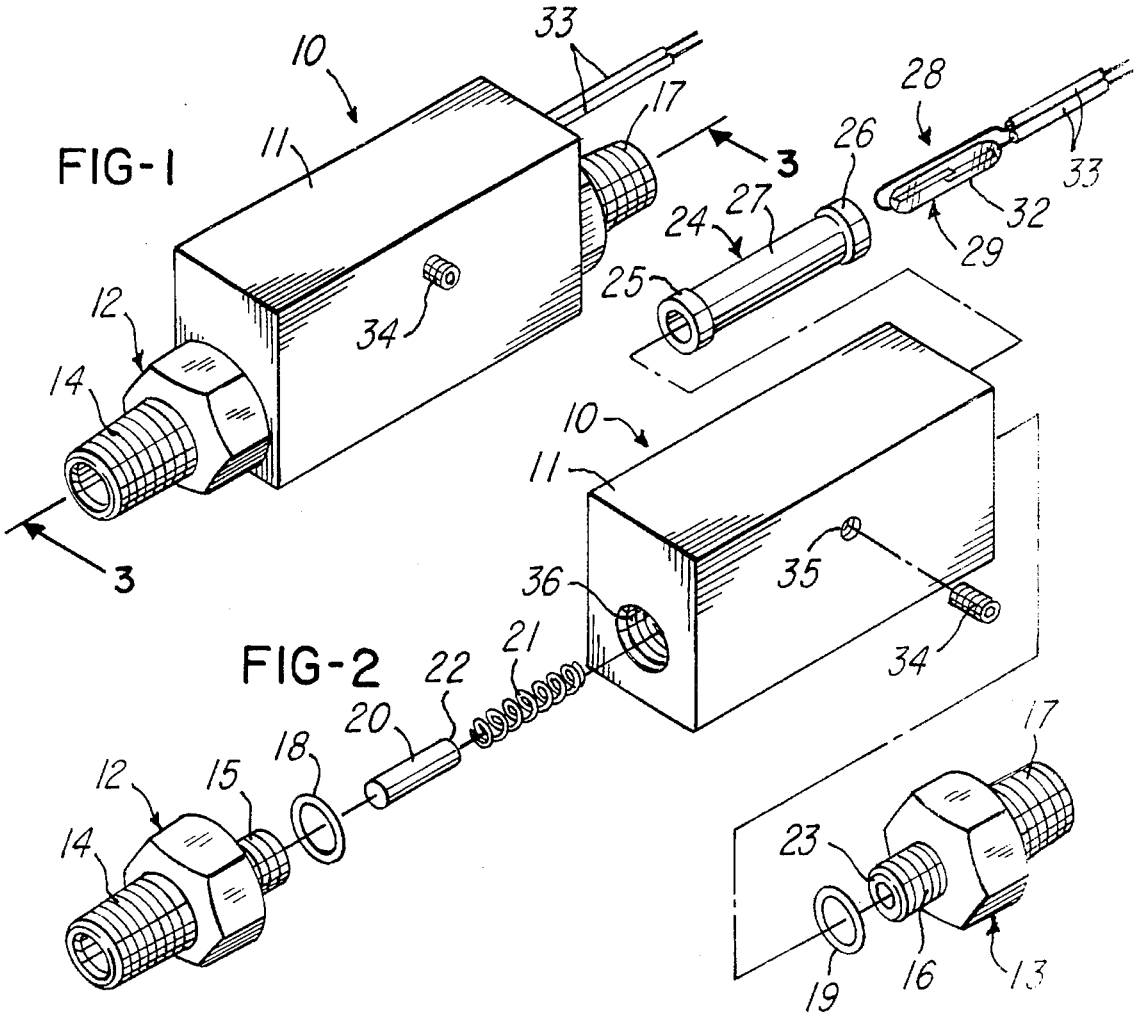
FIG-1
FIG-2
10
11
12
13
14
15
16
17
18
19
20
21
22
23
24
25
26
27
28
29
32
33
34
35
36
3
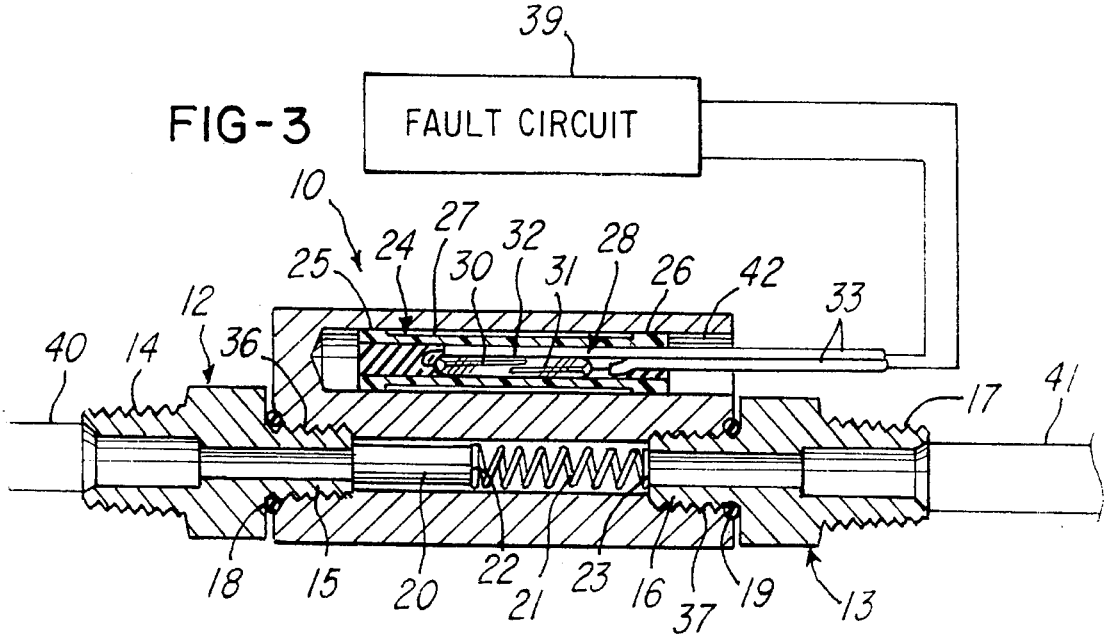
FIG-3
FAULT CIRCUIT
39
10
12
13
14
15
16
17
18
19
20
21
22
23
24
25
26
27
28
30
31
32
33
36
37
40
41
42

GREASE FLOW SENSOR SWITCH

BRIEF DESCRIPTION OF THE INVENTION

This invention is directed to a grease flow sensor switch assembly device for monitoring and determining movement of grease charges, e.g. a Number One (1) and Number Two (2) type grease. The device involves a dry reed switch, a magnet and a spring. The magnet, being moved into position by grease flow, puts out a magnetic field that brings the dry reed switch together, completing an electrical circuit. This circuit is then connected to a fault circuit which shuts off the machine in the event the desired grease charge was not received. An alarm source, viz., a light, sound or light/sound combination alarm indicating that the grease charge (desired amount of grease) was not distributed to that bearing or slide or whatever mechanism is being greased can also be present. The grease volume can be monitored by adjustments to the dry reed switch.

BACKGROUND OF THE INVENTION AND PRIOR ART

There has been a long-existing need in the field of manufacturing for a positive quality control device insuring verified grease application along with means for shutting down a machine or assembly line when the requisite grease charge has not been delivered to such grease fitting. Too frequently existing mechanisms for inserting grease into fittings fail to accomplish their desired task resulting in premature frictional damage to machine parts resulting in breakdowns. Moreover, there is at present no available device for insuring the delivery and monitoring of such highly viscous substances as Number One (1) and Number Two (2) grease.

Such highly viscous grease should be applied on a quality control fail safe basis such that if for some reason the grease charge is not delivered as desired, the machine or assembly line is automatically shut down to minimize or eliminate wear of machine parts, viz., those fittings to which no grease was delivered as desired.

It is also desired that the delivery and monitoring device be simple from a mechanical viewpoint; contain a minimum of moving parts; assure economy of motion and have a long life expectancy prior to necessity for replacement. Replacement, of course, would necessitate shutting down the machine or assembly line which is to be avoided.

A variety of devices can be found in the prior art for dispensation of oily lubricants and many of these are complicated and therefore expensive or require particular geometry and/or electrically complicated monitoring and control systems necessitating wasted motion.

U.S. Pat. No. 5,126,722 issued Jun. 30, 1992 to Peter A. Kamis, is directed to a piston-type point of lubrication magnetic flow indicator providing a barrel interfit with a bushing having a cylinder portion penetrating the barrel coaxially and a magnetic piston which reciprocates closely interfit inside the cylinder portion of the bushing. Lube oil enters an inlet port of the bushing, flows through a check valve into the cylinder portion, and impinges on one end of the magnetic piston. The impinging causes the magnetic piston to move in the cylinder portion uncovering at least one port formed through the cylinder portion which opens the cylinder portion to the barrel, directing flow thereto. The lubricating oil flows through the barrel and out of an aperture formed at a forward end of the barrel to a lubrication point. Movement of the magnetic piston through the cylinder portion triggers a magnetic reed switch mounted on an outside circumference of the barrel and generally overlying the relative axial position of the piston in the cylinder portion. The opening and closing of the reed switch can be electrically monitored by electronic lubrication monitoring systems or controls as are known.

U.S. Pat. No. 4,467,892 issued to David L. Van de Borgert on Aug. 28, 1984, is directed to a microlubrication system to divide and distribute a flow of lubricant automatically to one or more machines needing lubrication. Fail-safe, accurate distribution is said to be provided by diverting flow of lubricant from the distribution system most of the time, allowing lubricant to be distributed only at intervals. When the lubricant is being distributed, it flows at a high enough rate to allow accurate metering and division of flow, but the overall delivery rate is low enough to prevent wasting the lubricant. The system is preferably provided with what is stated to be a fail-safe means to insure lubrication or to shut off the machines to be lubricated in the event lubrications fail and cannot be quickly restored.

U.S. Pat. No. 3,993,165, issued to Erhard Pottrich on Nov. 23, 1976, is directed to a lubricant dosing device for double-action, two-conduit central lubricating systems, wherein a housing has therein two piston chambers, an outlet control chamber, two inlets for a pressurized lubricant, and two outlets for determining dosed amounts of the lubricant. One chamber is for a control piston and the other for a dosing piston; the longitudinal aces of all three chambers preferably pass through corners of an imaginary triangle perpendicular to the main axis of the housing. As a main feature, a reversible closing member is insertable in the control chamber, preferably including at least two communicating spaces, bores or grooves, by the aid of which the predetermined dosed amounts of the lubricant can be discharged, by the reciprocation of the dosing piston, selectively through one outlet of the device, when the closing member is inserted in one operative position, and through both outlets, when the closing member is axially reversed before insertion in the control chamber in another operative position. Preferably the axes of the lubricant outlets also pass through one of the corners of the imaginary triangle.

U.S. Pat. No. 3,381,776 issued to T. J. Gruber, et. al. on May 7, 1968, is directed to a lubrication control system for dispensing a measured amount of lubricant within a predetermined period of time having a lubrication dispensing piston, an electronic timing circuit responsive to the movement of the piston and a warning device controlled by the timing circuit for signalling a failure of the lubricating system to dispense an amount of lubricant within the predetermined time interval.

BRIEF DESCRIPTION OF THE DRAWINGS

FIG. 1 is a perspective view of the grease flow sensor switch of the present invention.

FIG. 2 is an exploded view of the grease flow sensor switch of FIG. 1.

FIG. 3 is a cross-sectional view, taken generally along the line 3—3 of FIG. 1.

DETAILED DESCRIPTION OF THE INVENTION

Figure 4:
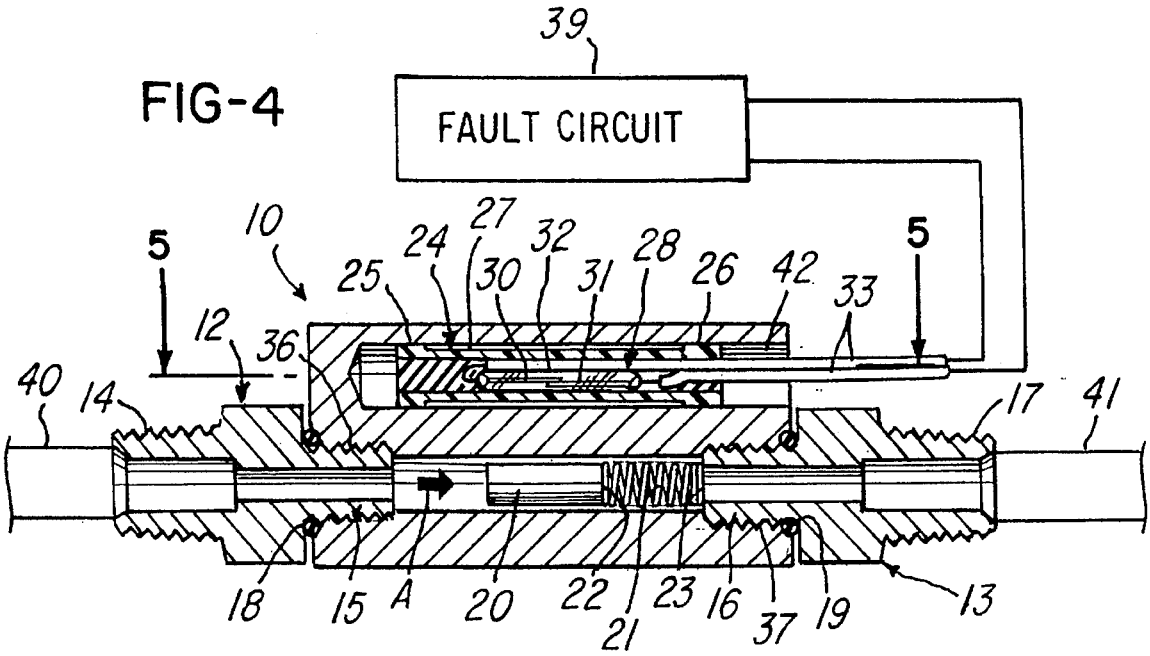
FIG. 4 is a cross-sectional view similar to FIG. 3 and showing a move position of the magnet and dry reed switch.

As will be apparent from FIGS. 1 and 2, the flow switch (10) of the present invention is positioned within housing (11). Inlet fitting (12) has a threaded upstream portion (14) and a threaded downstream portion (15). Correspondingly, grease outlet fitting (13) has a threaded upstream portion (16) and a threaded downstream portion (17).

The downstream portion (15) has an "0" Ring (18) and the threaded upstream portion of grease outlet fitting (13) has an "0" Ring (19). As is apparent from FIGS. 3 and 4, positioned within housing (11) of grease flow sensor switch (10) is a cylindrical magnet (20) which abuts helical compression spring (21) at one end face (23) of the threaded portion (16) of grease outlet fitting (13 and abuts face (22) of magnet (20) at the other end of cylindrical compression spring (21).

Dry reed switch assembly (28) has a tubular housing (24) containing one shoulder (25) at its one end and another shoulder (26) at its other end. The central or medial portion (27) of housing (24) is a reduced diameter portion. Located within dry reed switch assembly (28) is the dry reed switch (29) having electrical contacts (30 and (31), respectively. These contacts, as well as the dry reed switch itself, are located within glass or ceramic housing (32). Additional electrical connector means, e.g., electrical wires (33) are located at one end of the dry reed switch assembly.

Figure 5:
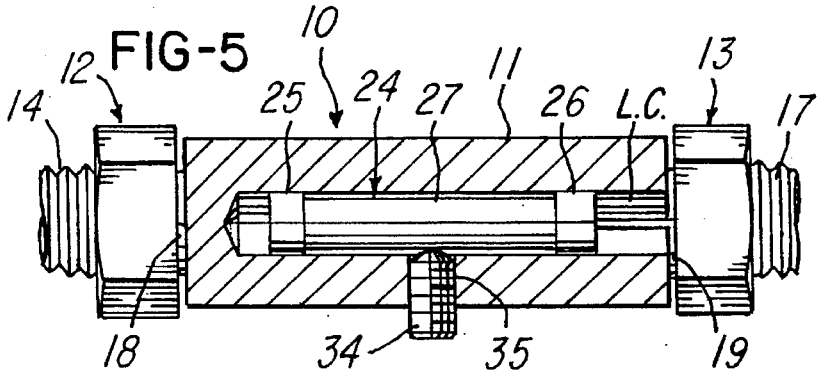
FIG. 5 is a cross-sectional view taken along the line 5—5 of FIG. 4 and showing a set screw positioning the dry reed switch.

As will be apparent from FIGS. 1, 2 and 5, set screw (34) is used to position the dry reed switch within the housing (11), and is located within a tapped opening (35) in the housing (11). Housing (11) contains tapped opening (36) serving as a second, e.g., lower chamber (L.C.) with opening (37) to receive grease inlet fitting (12) and a tapped opening (37) to receive grease outlet fitting (13). Tapped opening (37) is best shown in FIG. 3.

Figure 6:
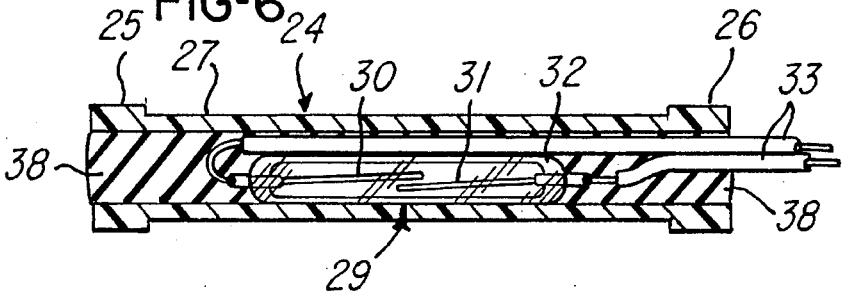
FIG. 6 is an enlarged fragmentary cross-sectional view of the dry reed switch sealed within a tubular housing.

As best seen in FIG. 6, the grease flow sensor switch of the present invention contains a positioning and insulating seal (38), composed of a rubbery sealant material which excludes moisture and insulates the dry reed switch from damage due to electrical shock and vibration shock. Conveniently, this can be composed of "BOSS SILICONE ADHESIVE SEALANT RTV" material, marketed by Accumetric, Inc. of Elizabeth, Ky. This material contains methyltriacetoxy silane, ethyl triacetoxy silane, silicon dioxide (amorphous silica) and polydimethyl siloxane. Other similar commercially available silicone adhesive sealants include, but are not necessarily limited to, the following: "RTV 159 SILICONE SEALANT" marketed by the Silicone Products Division of General Electric Company, Waterford, N.Y.; "RTV CLEAR SILICONE ADHESIVE 79685" marketed by KAR Products of Des Plaines, Ill.; "RTV SEALANT, CLEAR 93205" marketed by Lawson Products, Incorporated of Des Plaines, Ill.; and "SILASTIC (R) 732 RTV SEALANT" and "SILASTIC (R) 732 RTV SEALANT-CLEAR" marketed by Dow Corning Corporation of Midland, Mich.

The Arrow "A" as shown in FIG. 4 illustrates movement of a grease charge of individual portion causing magnet (20) to move within the second, e.g., lower chamber, portion between (36) and (37) in the direction shown, thus closing the dry reed switch, completing the contact electrically to deactivate the fault circuit (39). See FIGS. 3 and 4, with FIG. 4 showing the completion of the contact. Normally the fault circuit switch is in the active position so that if this contact is not made, the fault switch will activate an alarm device of the type discussed hereinafter.

Similarly, the fault circuit can be employed to stop movement of a machine and/or an assembly line so as to permit greater adherence to quality control by not allowing items to proceed or run which should have a grease charge but do not.

As will be apparent from FIGS. 3 and 4, an inlet tube or hose (40) is connected to the threaded upstream portion of grease inlet fitting (12). Correspondingly, an outlet tube or hose (41) is connected to the threaded downstream portion (17) of grease outlet fitting (13). Housing (11) is provided with a bore (42) as shown in FIGS. 3 and 4 which serves as a first, e.g., an upper, chamber for dry reed switch assembly (28). A corresponding bore (43) is shown in FIG. 7 for this embodiment containing a visual alarm, viz., a light.

Figure 7:
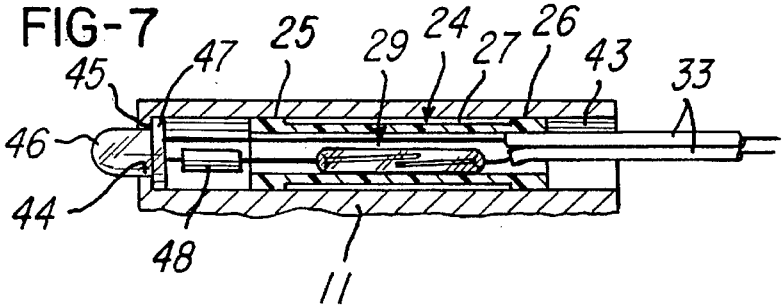
FIG. 7 is a fragmentary cross-sectional view of a modification wherein a dry reed switch is connected to a visual warning device.

Referring now to FIG. 7, it will be apparent that housing (11) has a reduced diameter portion (44) with a shoulder portion (45) serving as an abutment to retain light (46) which has a rim portion (47). A resistor (48) is connected to light (46) at one end and to reed switch (29) at its (the resistor's) other end. In FIG. 7, the "RTV" has not been shown in order to better illustrate the dry reed switch and connecting wires.

Figure 8:
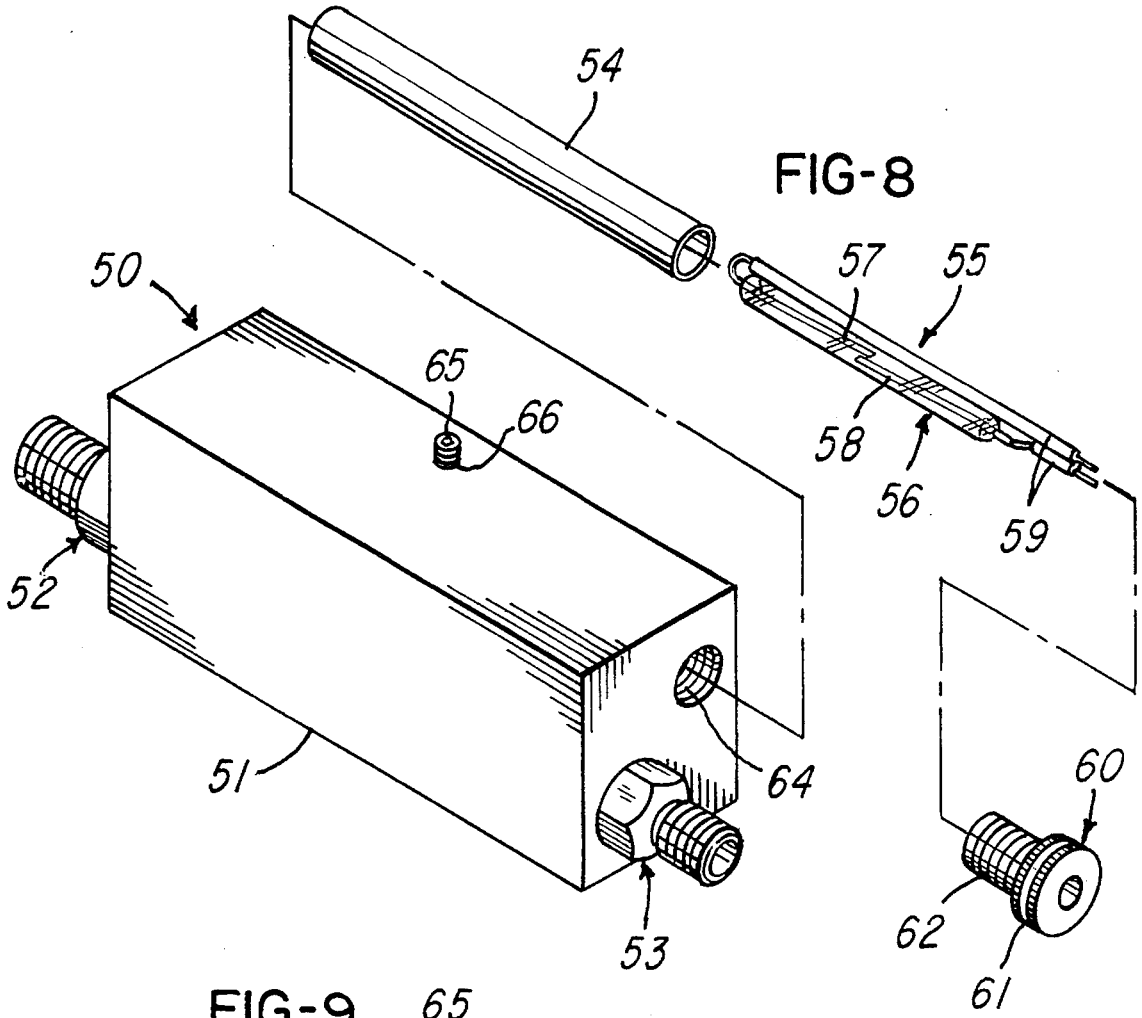
FIG. 8 is an exploded perspective view of a further modification of the grease flow sensor switch of this invention.

In accordance with an alternative embodiment of this invention, there is illustrated in FIG. 8 a modified grease flow sensor switch (50) contained within a housing (body) (51). This embodiment has inlet (52) and outlet (53). Located within housing (51) is dry reed switch tubular housing (54) containing the dry reed switch assembly (55) and the dry reed switch (56). Electrical contacts (57) and (58) contain electrical wires (59).

Figure 9:
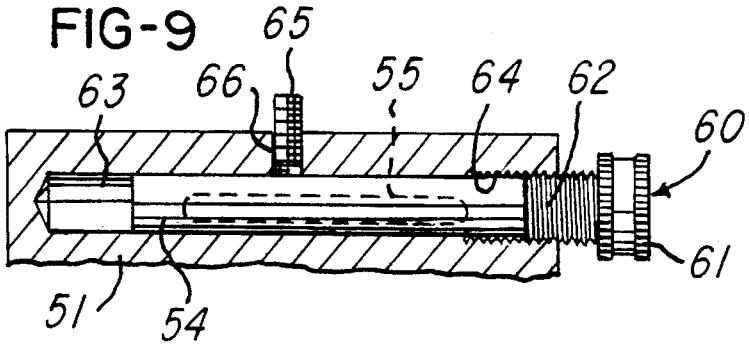
FIG. 9 is a fragmentary cross-sectional view of a dry reed switch with a threaded fine adjustment means.
Figure 10:
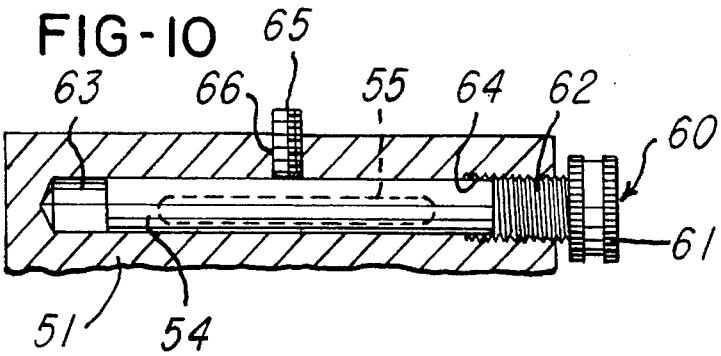
FIG. 10 is a fragmentary cross-sectional view similar to FIG. 9 showing a dry reed switch locked in position with a set screw.

As is apparent from FIGS. 8 through 10, the present invention can be provide with a threaded adjustment means (60), preferably capable of fine adjustment, for positioning the switch within housing (51). This adjustment means contains a knurled head portion (61) at one end and a threaded, preferably finely threaded, end portion (62) at its other end. The threaded end (62) of the adjustment means fits within a bore (63) serving as a first, e.g., an upper, chamber and having threads (64) mated with the threads (62) within the housing (51). Set screw (65) is then employed via tapped opening (66) containing internal threads to fix the position of the reed switch after attaining the desired adjustment, preferably fine adjustment, using threaded adjustment means (60).

So as long as the first and second chambers of the housing for the grease flow sensor switch assembly are positioned so as to achieve the desired magnetic field inducement of the requisite electrical contact as a necessary condition; the relative positioning of the first and second chambers with respect to one another is immaterial. Thus the first chamber can be an upper chamber with the second chamber being a lower chamber, or vice-versa. On the other hand, these chambers can be located adjacent to one another, or disposed in any angular relationship so long as the abovenoted necessary condition is observed.

I claim:

1. A quality control fail-safe grease flow sensor switch assembly for monitoring and determining movement of Number One (1) and Number Two (2) grease charges comprising a housing having first and second chambers; a dry reed switch assembly having electrical wire contacts in said first chamber; a magnet in said second chamber responsive to grease flow by movement into position to put out a magnetic field that brings said electrical wire contacts together completing an electrical circuit; a grease inlet fitting having inner and outer ends and connected to one end of said housing second chamber; a grease outlet fitting having inner and outer ends and connected at the other end of said housing second chamber; a helical compression spring located in said second chamber one end of which contacts said magnet and the other end of which contacts the inner end of said grease outlet fitting; a positioning and insulating seal for said dry reed switch and its electrical wire contacts; and additional electrical connector means located at one end of said dry reed switch assembly for connection thereof to a fault circuit capable of stopping a machine and/or assembly line in the event the desired grease charges are not received.

2. A grease flow sensor switch assembly as in claim 1 which includes "0" rings positioned between said grease inlet and grease outlet fittings and said housing second chamber.

3. A grease flow sensor switch assembly as in claim 1 wherein said magnet is cylindrical.

4. A grease flow sensor switch assembly as in claim 1 wherein said dry reed switch assembly has a tubular housing containing one shoulder at its one end, a central portion of reduced diameter and another shoulder at its other end.

5. A grease flow sensor switch assembly as in claim 1 wherein said dry reed switch and its electrical contacts are located within a glass or ceramic housing.

6. A grease flow sensor switch assembly as in claim 1 wherein a set screw positions said dry reed switch within its housing.

7. A grease flow sensor switch assembly as in claim 1 which includes an inlet tube is connected to the outer end of said grease inlet fitting and an outlet tube connected to the outer end of said grease outlet fitting.

8. A grease flow sensor switch assembly as in claim 1 which includes a visual alarm connected to one end of said dry reed switch via a resistor.

9. A grease flow sensor switch assembly as in claim 1 which includes a threaded adjustment means by which said dry reed switch is adjusted and positioned within its housing.

10. A grease flow sensor switch assembly as in claim 1 wherein said positioning and insulating seal is a rubbery sealant material.

11. A grease flow sensor switch assembly as in claim 1 wherein said first chamber is an upper chamber.

12. A grease flow sensor switch assembly as in claim 1 wherein said second chamber is a lower chamber.

* * * * *